US012728311B2

(12) United States Patent
Soller

(10) Patent No.: US 12,728,311 B2
(45) Date of Patent: Sep. 8, 2026

(54) EXERCISE APPARATUS

(71) Applicant: Expectations, LLC, Bonney Lake, WA (US)

(72) Inventor: Nicholas M. Soller, Orting, WA (US)

(73) Assignee: Expectations, LLC, Bonney Lake, WA (US)

( * ) Notice: Subject to any disclaimer, the term of this patent is extended or adjusted under 35 U.S.C. 154(b) by 31 days.

(21) Appl. No.: 19/016,569

(22) Filed: Jan. 10, 2025

(65) Prior Publication Data

US 2026/0199727 A1 Jul. 16, 2026

(51) Int. Cl.
*A63B 22/00* (2006.01)
*A63B 21/00* (2006.01)

(52) U.S. Cl.
CPC ..... *A63B 22/0056* (2013.01); *A63B 21/154* (2013.01); *A63B 21/4034* (2015.10); *A63B 21/4035* (2015.10); *A63B 21/4047* (2015.10); *A63B 22/001* (2013.01); *A63B 22/0046* (2013.01); *A63B 2208/0233* (2013.01); *A63B 2210/50* (2013.01)

(58) Field of Classification Search
CPC . A63B 22/0056; A63B 21/018; A63B 21/154; A63B 21/4034; A63B 21/4035; A63B 21/4047; A63B 22/001; A63B 22/0046; A63B 2208/0233; A63B 2210/50; A63B 21/225; A63B 2022/0676; A63B 22/0015; A63B 2225/09; A63B 2022/067; A63B 2022/0682; A63B 2022/206; A63B 23/03575; A63B 21/4033; A63B 2022/0652; A63B 22/06–2022/0635; A63B 22/0048–2022/0053; A63B 22/0664–2022/0688
See application file for complete search history.

(56) References Cited

U.S. PATENT DOCUMENTS

| | | | |
|---|---|---|---|
| 6,168,552 | B1 | 1/2001 | Eschenbach |
| 6,176,814 | B1 | 1/2001 | Ryan et al. |
| 6,390,954 | B1 | 5/2002 | Lee |
| 6,422,977 | B1 | 7/2002 | Eschenbach |
| 6,436,007 | B1 | 8/2002 | Eschenbach |
| 6,440,042 | B2 | 8/2002 | Eschenbach |
| 6,454,682 | B1 | 9/2002 | Kuo |

(Continued)

*Primary Examiner* — Megan Anderson
*Assistant Examiner* — Catrina A Letterman
(74) *Attorney, Agent, or Firm* — Dicke, Billig & Czaja, PLLC

(57) ABSTRACT

A front crank assembly is configured and arranged for use with an exercise apparatus having a support frame positioned proximate a front of the exercise apparatus. A crank wheel is rotatably connected to a front support frame portion of the support frame. A crank link has a first crank link end pivotally connected to the crank wheel. An elongate member has a first elongate member end pivotally connected to a top support frame portion proximate a rear support frame portion. The crank link has a second crank link end pivotally connected to an elongate member intermediate portion. A pedal link has a first pedal link end pivotally connected to the top support frame portion proximate the front. A pedal has a first pedal end, a pedal intermediate portion pivotally connected to a second pedal link end, and a second pedal end pivotally connected to the second elongate member end.

19 Claims, 12 Drawing Sheets

(56) References Cited

U.S. PATENT DOCUMENTS 6,758,790 B1 7/2004 Ellis
7,022,049 B2 4/2006 Ryan et al.
7,037,242 B2 5/2006 Lo et al.
7,153,239 B1 12/2006 Stearns et al.
7,207,925 B2 4/2007 Moon
7,270,626 B2 9/2007 Porth
7,361,122 B2 4/2008 Porth
7,448,986 B1 11/2008 Porth
7,494,447 B2 2/2009 Eschenbach
7,513,854 B1 4/2009 Stearns et al.
7,520,839 B2 4/2009 Rodgers, Jr.
7,530,926 B2 5/2009 Rodgers, Jr.
7,618,350 B2 11/2009 Dalebout et al.
7,641,598 B2 1/2010 Rodgers, Jr.
7,651,445 B1 1/2010 Chen
7,654,936 B2 2/2010 Liao et al.
7,670,266 B2 3/2010 Cornejo et al.
7,674,205 B2 3/2010 Dalebout et al.
7,678,025 B2 3/2010 Rodgers, Jr.
7,682,290 B2 3/2010 Liao et al.
7,708,669 B2 5/2010 Rodgers, Jr.
7,713,176 B1 5/2010 Farney
7,722,505 B2 5/2010 Liao et al.
7,736,278 B2 6/2010 Lull et al.
7,744,508 B2 6/2010 Liao et al.
7,775,942 B2 8/2010 Hildebrandt et al.
7,828,698 B2 11/2010 Rodgers, Jr.
7,841,968 B1 11/2010 Eschenbach
7,854,691 B2 12/2010 Long et al.
7,878,947 B1 2/2011 Rodgers, Jr.
7,938,754 B2 5/2011 Eschenbach
7,946,962 B2 5/2011 Long
7,972,248 B2 7/2011 Liao et al.
7,976,435 B2 7/2011 Van Handel et al.
7,988,600 B2 8/2011 Rodgers, Jr.
7,993,247 B1 8/2011 Eschenbach
8,021,275 B2 9/2011 Rodgers, Jr.
8,051,752 B2 11/2011 Murray et al.
8,057,363 B2 * 11/2011 Giannelli ..... A63B 22/001 482/52
8,092,351 B1 1/2012 Rodgers, Jr.
8,113,996 B1 2/2012 Allen
8,133,159 B2 3/2012 Eschenbach
8,272,995 B2 9/2012 Stearns et al.
8,317,663 B2 11/2012 Stewart et al.
8,540,609 B2 9/2013 Anderson et al.
8,545,372 B2 10/2013 Wang
8,663,070 B2 3/2014 Long
8,668,627 B2 3/2014 Eschenbach
8,808,148 B2 8/2014 Watterson et al.
8,814,757 B2 8/2014 Eschenbach
8,840,529 B2 9/2014 Chen
8,870,716 B2 10/2014 Murray et al.
8,894,549 B2 11/2014 Colledge
8,974,352 B2 3/2015 Eschenbach
9,017,223 B2 4/2015 Eschenbach
9,050,498 B2 6/2015 Lu et al.
9,067,094 B2 6/2015 Chang et al.
9,108,081 B2 8/2015 Giannelli et al.
9,114,275 B2 8/2015 Lu et al.
9,138,614 B2 9/2015 Lu et al.
9,199,115 B2 12/2015 Mm et al.
9,199,116 B1 12/2015 Huang et al.
9,227,103 B2 1/2016 Yang
9,248,071 B1 2/2016 Benda et al.
9,248,338 B2 2/2016 Lo
9,248,339 B2 2/2016 Lo
9,259,610 B2 2/2016 Huang et al.
9,272,181 B2 3/2016 Arnold et al.
9,283,425 B2 3/2016 Lu et al.
9,339,684 B2 5/2016 Liao et al.
9,364,707 B2 6/2016 Grossmann
9,463,351 B2 10/2016 Long
9,468,795 B2 10/2016 Arnold et al.
9,566,466 B2 2/2017 Huang et al.
9,579,537 B1 * 2/2017 Peng ..... A63B 22/0664
9,586,087 B1 3/2017 Lin
9,630,049 B2 4/2017 Hartman et al.
9,630,052 B2 4/2017 Peng
9,662,535 B2 5/2017 Long
9,717,947 B2 8/2017 Lin
9,724,559 B2 8/2017 Chang et al.
9,802,076 B2 10/2017 Murray et al.
9,808,667 B2 11/2017 Liao et al.
9,827,458 B2 11/2017 Dalton
9,849,332 B1 12/2017 Huang et al.
9,914,016 B2 3/2018 Lin
9,931,534 B2 4/2018 Huang
9,937,377 B2 4/2018 McInelly et al.
9,937,378 B2 4/2018 Dalebout et al.
9,950,209 B2 4/2018 Yim et al.
9,987,513 B2 6/2018 Yim et al.
10,010,755 B2 7/2018 Watterson
10,010,756 B2 7/2018 Watterson
10,022,586 B1 7/2018 Lee et al.
10,022,588 B1 7/2018 Lee et al.
10,046,196 B2 8/2018 Ercanbrack et al.
10,086,227 B2 10/2018 Merli
10,112,067 B2 10/2018 Golesh
10,207,147 B2 2/2019 Ercanbrack et al.
10,252,101 B2 4/2019 Yim et al.
10,328,301 B2 6/2019 Anderson et al.
10,369,403 B2 8/2019 Liao et al.
10,471,300 B2 11/2019 Chen
10,500,436 B1 12/2019 Lu
10,518,128 B2 12/2019 Liu
10,532,246 B2 1/2020 Liao et al.
10,543,396 B2 1/2020 Mm et al.
10,549,144 B2 2/2020 Kuo
10,561,891 B2 2/2020 Luger et al.
10,576,331 B2 3/2020 Kuo
10,625,114 B2 4/2020 Ercanbrack
10,632,341 B2 4/2020 Liu
10,653,914 B2 5/2020 Ellis et al.
10,688,338 B2 6/2020 Hsu
10,716,965 B2 7/2020 Liu
10,806,965 B2 10/2020 Lee et al.
10,814,160 B2 10/2020 Liao et al.
10,926,131 B2 2/2021 Yu et al.
10,926,132 B1 2/2021 Lo
10,933,273 B2 3/2021 Liao et al.
10,960,261 B2 3/2021 Liao et al.
11,020,626 B2 6/2021 Yu et al.
11,110,318 B2 9/2021 Lo
11,154,748 B2 10/2021 Liu et al.
11,198,033 B2 12/2021 Yim et al.
11,247,097 B2 2/2022 Chen
11,305,150 B2 4/2022 Lee et al.
11,324,994 B2 5/2022 Yim et al.
11,413,497 B2 8/2022 Venturella et al.
11,452,906 B2 9/2022 Leier et al.
11,504,575 B2 11/2022 Chen
11,524,206 B2 12/2022 Ellis
11,529,544 B2 12/2022 Liao et al.
11,583,726 B2 2/2023 Tracy
11,633,643 B2 4/2023 Leier et al.
11,673,019 B2 6/2023 Venturella et al.
11,731,003 B2 8/2023 Kuo
11,771,950 B2 10/2023 Rose
11,801,412 B2 * 10/2023 Hsu ..... A63B 21/00069
11,801,419 B2 10/2023 Bissonnette et al.
11,857,822 B2 1/2024 Hsu
11,969,623 B2 4/2024 Li et al.
2008/0188359 A1 * 8/2008 Wu ..... A63B 21/157 482/57
2008/0269022 A1 * 10/2008 Lee ..... A63B 22/0056 482/52
2008/0274860 A1 * 11/2008 Lee ..... A63B 22/001 482/52
2015/0141207 A1 * 5/2015 Eschenbach ..... A63B 22/001 482/52
2015/0246260 A1 * 9/2015 Giannelli ..... A63B 23/0476 482/8

(56) References Cited

U.S. PATENT DOCUMENTS

| | | | | |
|---|---|---|---|---|
| 2016/0046351 | A1* | 2/2016 | Thomas | A63B 21/227 482/57 |
| 2018/0272181 | A1* | 9/2018 | Giannelli | A63B 23/03591 |
| 2022/0296959 | A1 | 9/2022 | Li et al. | |
| 2022/0401793 | A1 | 12/2022 | Yim et al. | |
| 2023/0381579 | A1 | 11/2023 | Venturella et al. | |
| 2024/0198160 | A1 | 6/2024 | Yeh | |

* cited by examiner

EXERCISE APPARATUS

BACKGROUND

Some manually operated exercise apparatus accommodate users in a seated position to perform exercises by moving their legs and optionally their arms, and these exercise apparatus provide beneficial cardiovascular exercise while minimizing impact on the users' joints. A variety of exercise apparatus have been developed to resist exercise motion, and embodiments of the present invention provide improved exercise apparatus.

For the reasons stated above and for other reasons stated below, which will become apparent to those skilled in the art upon reading and understanding the present specification, there is a need in the art for an improved exercise apparatus.

SUMMARY

The above-mentioned problems associated with prior devices are addressed by embodiments of the disclosure and will be understood by reading and understanding the present specification. The following summary is made by way of example and not by way of limitation. It is merely provided to aid in understanding some of the aspects of the invention.

In one embodiment, a front crank assembly is configured and arranged for use with an exercise apparatus having a support frame including a top support frame portion, a bottom support frame portion, a front support frame portion, and a rear support frame portion. The support frame is positioned proximate a front of the exercise apparatus. The front crank assembly comprises a crank wheel, a crank link, an elongate member, a pedal link, and a pedal. The crank wheel is rotatably connected to the front support frame portion of the support frame. The crank link has a first crank link end and a second crank link end, the first crank link end being pivotally connected to the crank wheel. The elongate member has a first elongate member end, an elongate member intermediate portion, and a second elongate member end. The first elongate member end is pivotally connected to the top support frame portion proximate the rear support frame portion, and the second crank link end is pivotally connected to the elongate member intermediate portion. The pedal link has a first pedal link end, a pedal link intermediate portion, and a second pedal link end. The first pedal link end is pivotally connected to the top support frame portion proximate the front. The pedal has a first pedal end, a pedal intermediate portion, and a second pedal end. The second elongate member end is pivotally connected to the second pedal end, and the second pedal link end is pivotally connected to the pedal intermediate portion.

In one embodiment, a front crank assembly for use with an exercise apparatus comprises a support frame, a crank wheel, a crank link, and elongate member, a pedal link, and a pedal. The support frame includes a top support frame portion, a bottom support frame portion, a front support frame portion, and a rear support frame portion. The support frame is positioned proximate a front of the exercise apparatus. The crank wheel is rotatably connected to the front support frame portion of the support frame. The crank link has a first crank link end and a second crank link end. The first crank link end is pivotally connected to the crank wheel. The elongate member has a first elongate member end, an elongate member intermediate portion, and a second elongate member end. The first elongate member end is pivotally connected to the top support frame portion proximate the rear support frame portion, and the second crank link end is pivotally connected to the elongate member intermediate portion. The pedal link has a first pedal link end, a pedal link intermediate portion, and a second pedal link end. The first pedal link end is pivotally connected to the top support frame portion proximate the front, and the pedal link intermediate portion is bent. The pedal has a first pedal end, a pedal intermediate portion, and a second pedal end. The second elongate member end is pivotally connected to the second pedal end, and the second pedal link end is pivotally connected to the pedal intermediate portion.

In one embodiment, an exercise apparatus comprises a base frame, a seat assembly, a support frame, and linkage assemblies. The base frame is configured and arranged to occupy a stable operating position on an underlying horizontal support surface, and the base frame defines a front end and a rear end. The seat assembly is selectively coupled to the rear end of the base frame and includes a seat facing the front end of the base frame thereby defining a right side and a left side relative to a user's sagittal plane when the user is seated on the seat. The support frame extends upward from the base frame proximate the front end of the base frame. A first axis extends through and outward from opposing sides of the support frame substantially perpendicular to the sagittal plane. A second axis extends through and outward from opposing sides of the support frame substantially perpendicular to the sagittal plane, superior and rearward of the first axis. A third axis extends through and outward from opposing sides of the support frame substantially perpendicular to the sagittal plane, superior of the first axis, substantially horizontal and forward of the second axis, disposed medially to the first axis and the second axis. A crank axle is rotatably mounted to the support frame and coaxial with the first axis. A crank wheel is operatively connected to the crank axle. A first linkage assembly is disposed to the right side of the base frame and comprises a right crank link having a first right crank link end and a second right crank link end, the first right crank link end being pivotally connected to the crank wheel; a right elongate member having a first right elongate member end, a right elongate member intermediate portion, and a second right elongate member end, the first right elongate member end being pivotally connected to a top support frame portion proximate a rear support frame portion, the second right crank link end being pivotally connected to the right elongate member intermediate portion; a right pedal link having a first right pedal link end, a right pedal link intermediate portion, and a second right pedal link end, the first right pedal link end being pivotally connected to the top support frame portion proximate a front support frame portion; and a right pedal having a first right pedal end, a right pedal intermediate portion, and a second right pedal end, the second right elongate member end being pivotally connected to the second right pedal end, and the second right pedal link end being pivotally connected to the right pedal intermediate portion. A second linkage assembly is disposed to the left side of the base frame and comprises a left crank link having a first left crank link end and a second left crank link end, the first left crank link end being pivotally connected to the crank wheel; a left elongate member having a first left elongate member end, a left elongate member intermediate portion, and a second left elongate member end, the first left elongate member end being pivotally connected to the top support frame portion proximate the rear support frame portion, the second left crank link end being pivotally connected to the left elongate member intermediate portion; a left pedal link having a first left pedal link end, a left pedal link intermediate portion, and a second left pedal link end, the first left pedal link end being pivotally connected to the top support frame portion proximate the front support frame portion; and a left pedal having a first left pedal end, a left pedal intermediate portion, and a second left pedal end, the second left elongate member end being pivotally connected to the second left pedal end, and the second left pedal link end being pivotally connected to the left pedal intermediate portion. The first linkage assembly and the second linkage assembly are disposed within a transverse projection of a first pedal path of the first pedal to a second pedal path of the second pedal.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. In accordance with common practice, the various described features are not drawn to scale but are drawn to emphasize specific features relevant to the present disclosure. Reference characters denote like elements throughout the Figures and the text.

DETAILED DESCRIPTION

In the following detailed description, reference is made to the accompanying drawings, which form a part hereof, and in which is shown by way of illustration embodiments in which the disclosure may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that other embodiments may be utilized and mechanical changes may be made without departing from the spirit and scope of the present disclosure. The following detailed description is, therefore, not to be taken in a limiting sense.

Embodiments of the disclosure generally provide a linkage assembly for use with an exercise apparatus having a support frame including a top support frame portion, a bottom support frame portion, a front support frame portion, and a rear support frame portion. The support frame is positioned proximate a front of the exercise apparatus. The linkage assembly includes a crank wheel rotatably connected to the front support frame portion of the support frame. A crank link has a first crank link end and a second crank link end, and the first crank link end is pivotally connected to the crank wheel. An elongate member has a first elongate member end, an elongate member intermediate portion, and a second elongate member end. The first elongate member end is pivotally connected to the top support frame portion proximate the rear support frame portion, and the second crank link end is pivotally connected to the elongate member intermediate portion. A pedal link has a first pedal link end, a pedal link intermediate portion, and a second pedal link end. The first pedal link end is pivotally connected to the top support frame portion proximate the front. A pedal has a first pedal end, a pedal intermediate portion, and a second pedal end. The second elongate member end is pivotally connected to the second pedal end, and the second pedal link end is pivotally connected to the pedal intermediate portion. Optionally, an arm or handle can be operatively connected to the elongate member, for example with an arm link interconnecting the elongate member intermediate portion and an arm support operatively connected to the arm or handle. These components generally form a front crank assembly.

Figure 12:
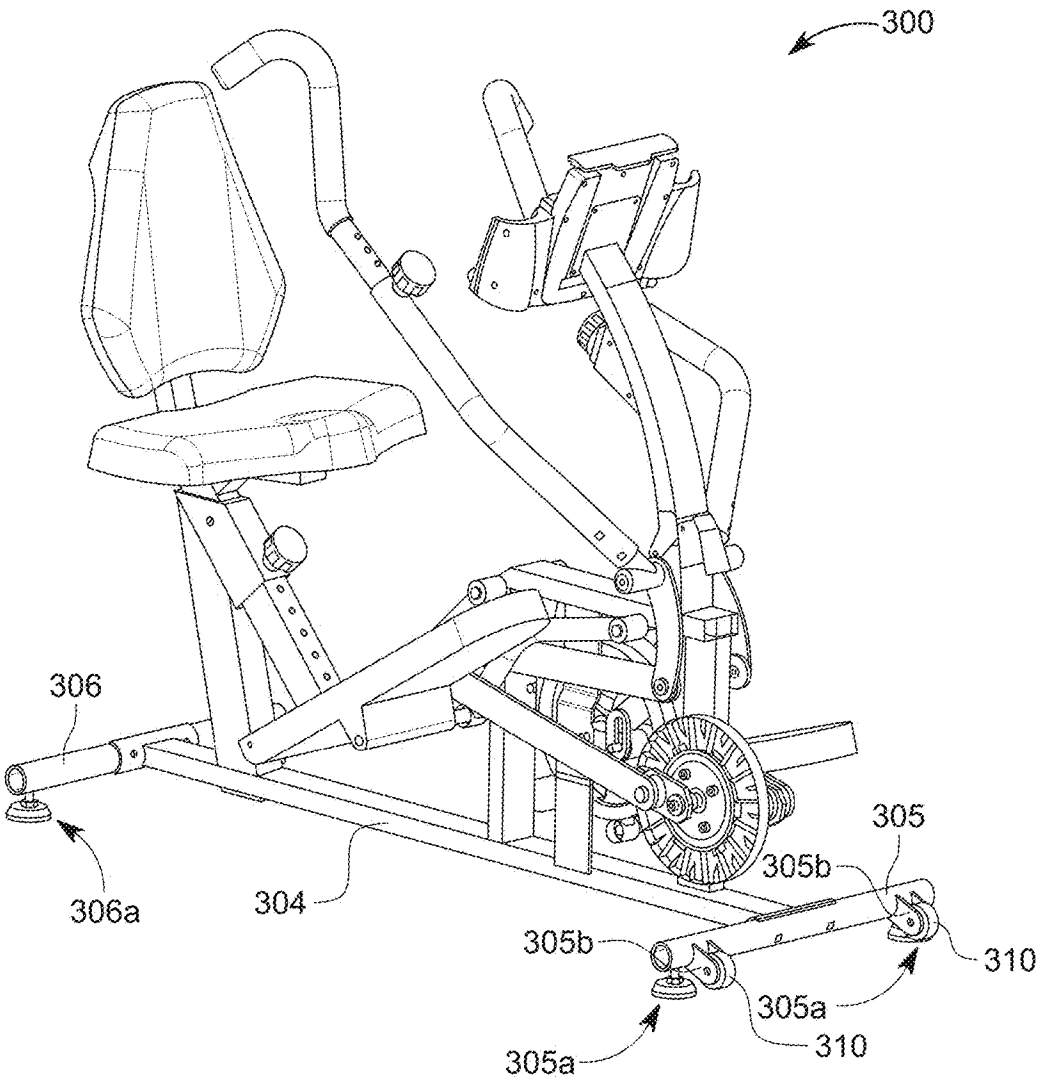
FIG. 12 is a front perspective view of another embodiment exercise apparatus constructed in accordance with the principles of the present invention.

In one embodiment, best illustrated in FIGS. 1-4, an exercise apparatus 100 includes a frame 102, which includes a base frame 104, a support frame 111, and a seat frame 108. The base frame 104 is configured and arranged to occupy a stable operating position on an underlying horizontal support surface, such as a floor, and the base frame 104 defines a front end to which a front stabilizer 105 is operatively connected and a rear end to which a rear stabilizer 106 is operatively connected. Optionally, one or both of the front and rear stabilizers can include wheels for assisting in moving the exercise apparatus. Preferably, at least the front stabilizer 105 includes wheels. FIG. 12 illustrates an example of an embodiment with wheels 310. The exercise apparatus 300 includes a base frame 304 with front and rear stabilizers 305 and 306, which can include stabilizing adjusters 305*a* and 306*a* to adjust the height proximate each end and level the exercise apparatus 300 in the event there is an uneven surface supporting the exercise apparatus 300. The front stabilizer 305 can include extensions 305*b* to which a wheel 310 is pivotally connected proximate each end of the front stabilizer 305. When the rear stabilizer 306 is lifted upward, so that support is transferred to the wheels 310, the exercise apparatus 300 can be easily moved with the wheels 310. The front stabilizing adjusters 305*a* can be shortened prior to lifting the rear stabilizer 306 so as to not put too much strain on the front stabilizing adjusters 305*a*.

A seat assembly 109 is selectively coupled to the seat frame 108 proximate the rear end of the base frame 104 and includes a seat 110 facing the front end of the base frame 104. When a user is seated on the seat 110 facing forward, a right side and a left side of the exercise apparatus are defined relative to the user's sagittal plane. There is preferably a space 120 between the support frame 111 and the seat frame 108/seat assembly 109 configured and arranged to allow the user to step through the space 120 for positioning on and off the exercise apparatus 100. In an example, the seat 110 has an adjustable height relative to the base frame 104, and preferably the adjustment is angled to increase the distance between the seat back and the support frame 111 as the height is increased.

The support frame 111 includes a front support frame 112 and a rear support frame 122 extending upward from the base frame 104. A top support frame 140 interconnects top portions of the front support frame 112 and the rear support frame 122. A first end 141 of the top support frame 140 is operatively connected to the top of the front support frame 112, and a second end 143 of the top support frame 140 is operatively connected to the top of the rear support frame 122. A first axle 142 (forming a third axis) extends outward from each side of the top support frame 140 proximate the first end 141, and a second axle 144 (forming a second axis) extends outward from each side of the top support frame 140 proximate the second end 143. A vertically extending interconnecting support frame 130 interconnects intermediate portions of the base frame 104 and the top support frame 140, preferably on one side, such as the right side in this example, between the front and rear support frames 112 and 122. An axle 131 (forming a fifth axis) extends inward from the support frame 130 and a resistance wheel 132, including a resistance pulley 137 (first pulley), rotates about the axle 131. An extension 133 extends from the support frame 130 toward the front support frame 112 and includes a slot 134 in which an axle 135, about which an idler pulley 136 (third pulley) rotates, is positioned. A horizontally extending interconnecting support frame 124 is preferably positioned on each side, with a first end 125 operatively connected to the front support frame 112 and a second end 128 operatively connected to the rear support frame 122, to interconnect the front and rear support frames and form a cavity therebetween in which the resistance wheel 132 is positioned. An outer axle 127 extends outward from an intermediate portion 126 of the interconnecting support frames 124.

Figure 1:
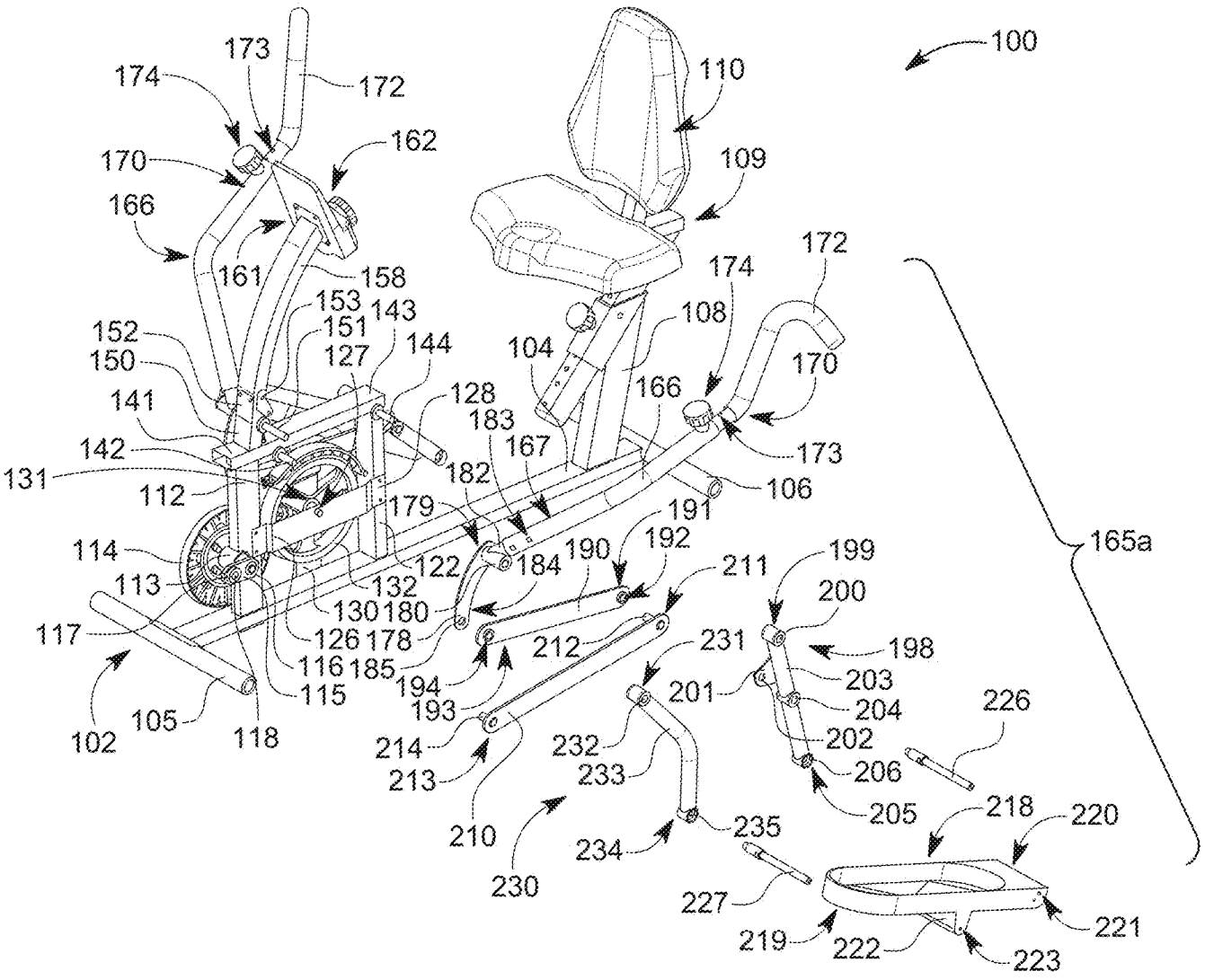
FIG. 1 is a partially exploded perspective view of an embodiment exercise apparatus constructed in accordance with the principles of the present invention.
Figure 2:
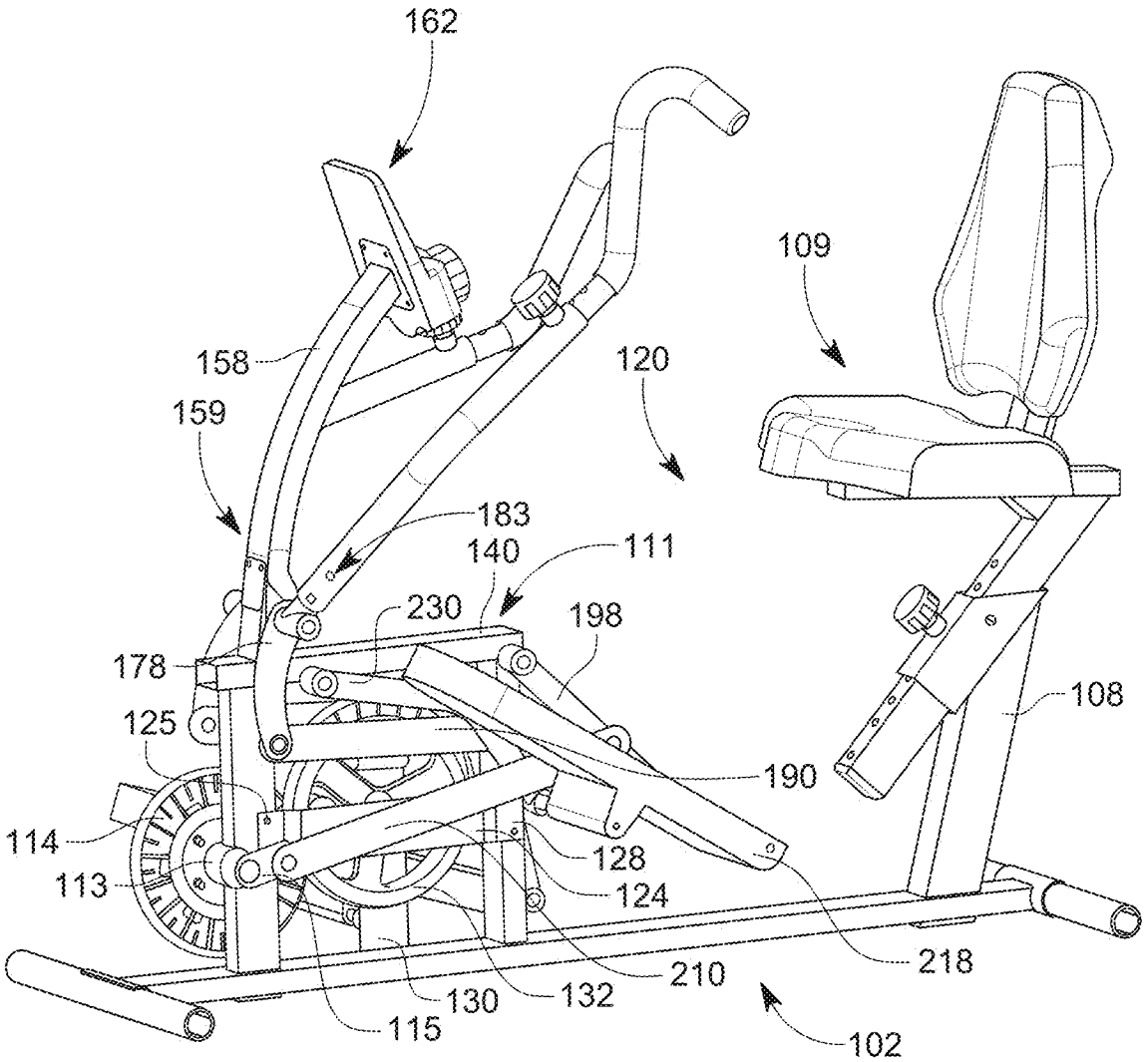
FIG. 2 is a perspective view of the exercise apparatus shown in FIG. 1 in a first position.
Figure 3:
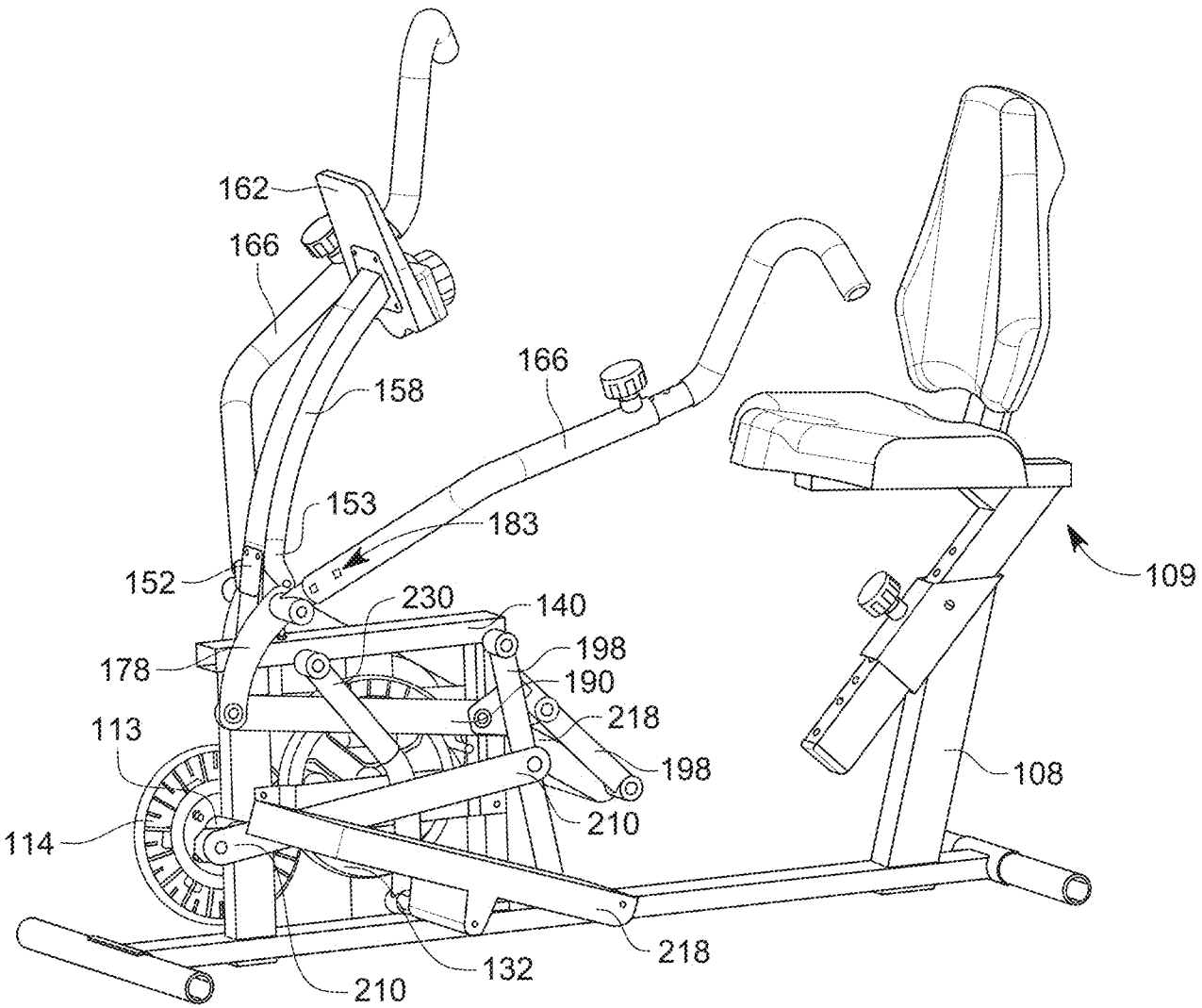
FIG. 3 is a perspective view of the exercise apparatus shown in FIG. 1 in a second position.
Figure 4:
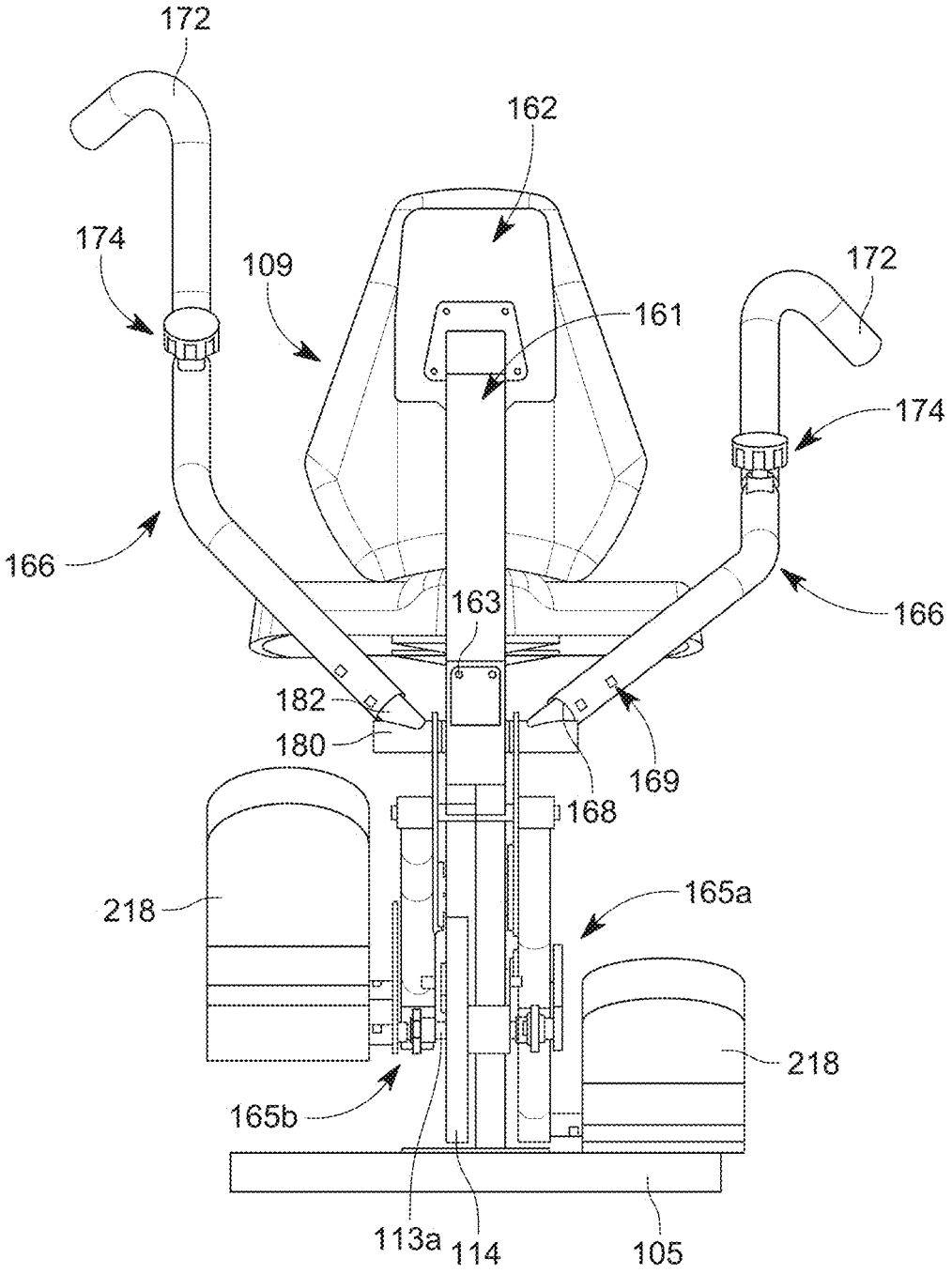
FIG. 4 is a front view of the exercise apparatus shown in FIG. 1.
Figure 5:
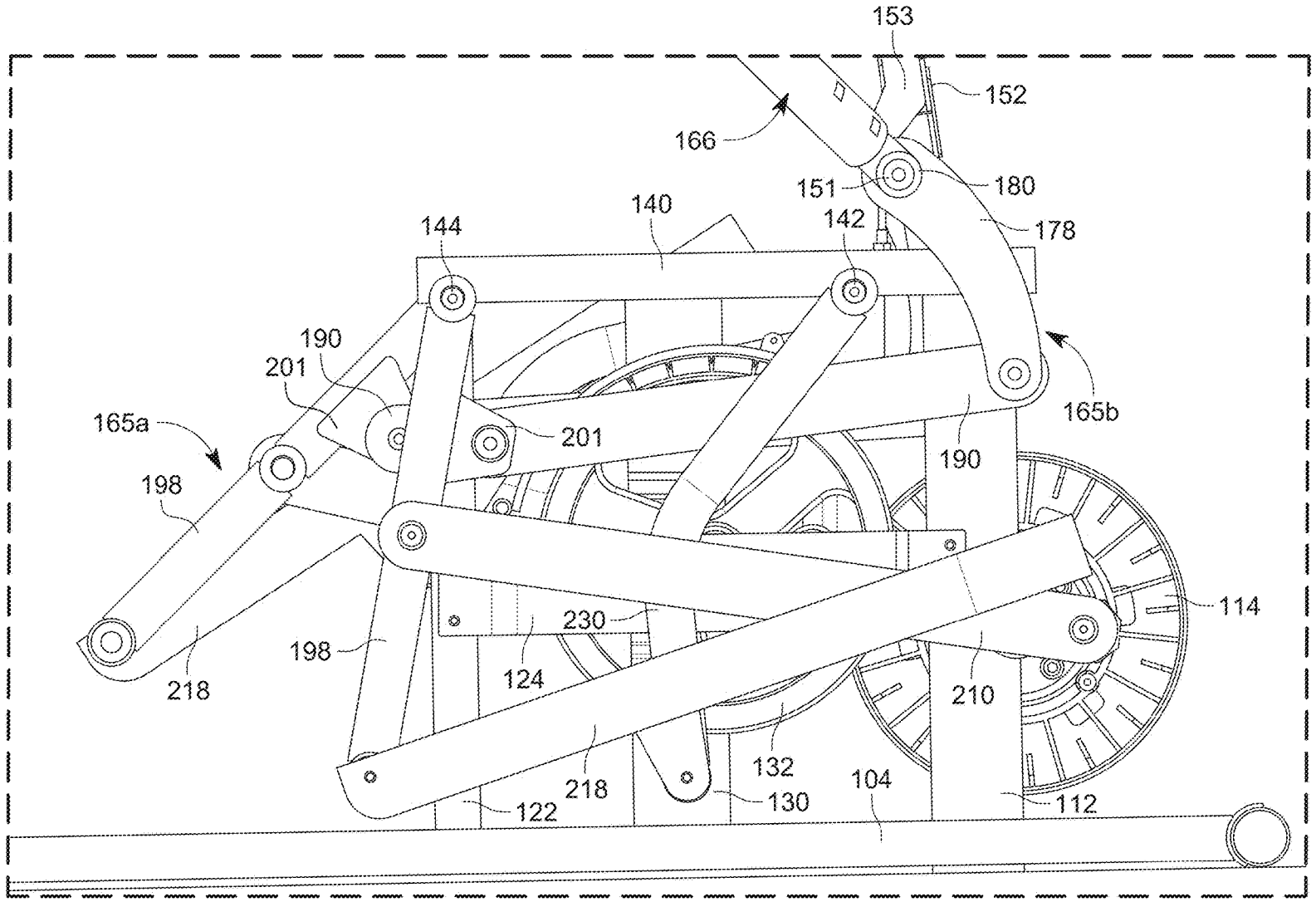
FIG. 5 is a side view of a linkage assembly of the exercise apparatus shown in FIG. 1.
Figure 6:
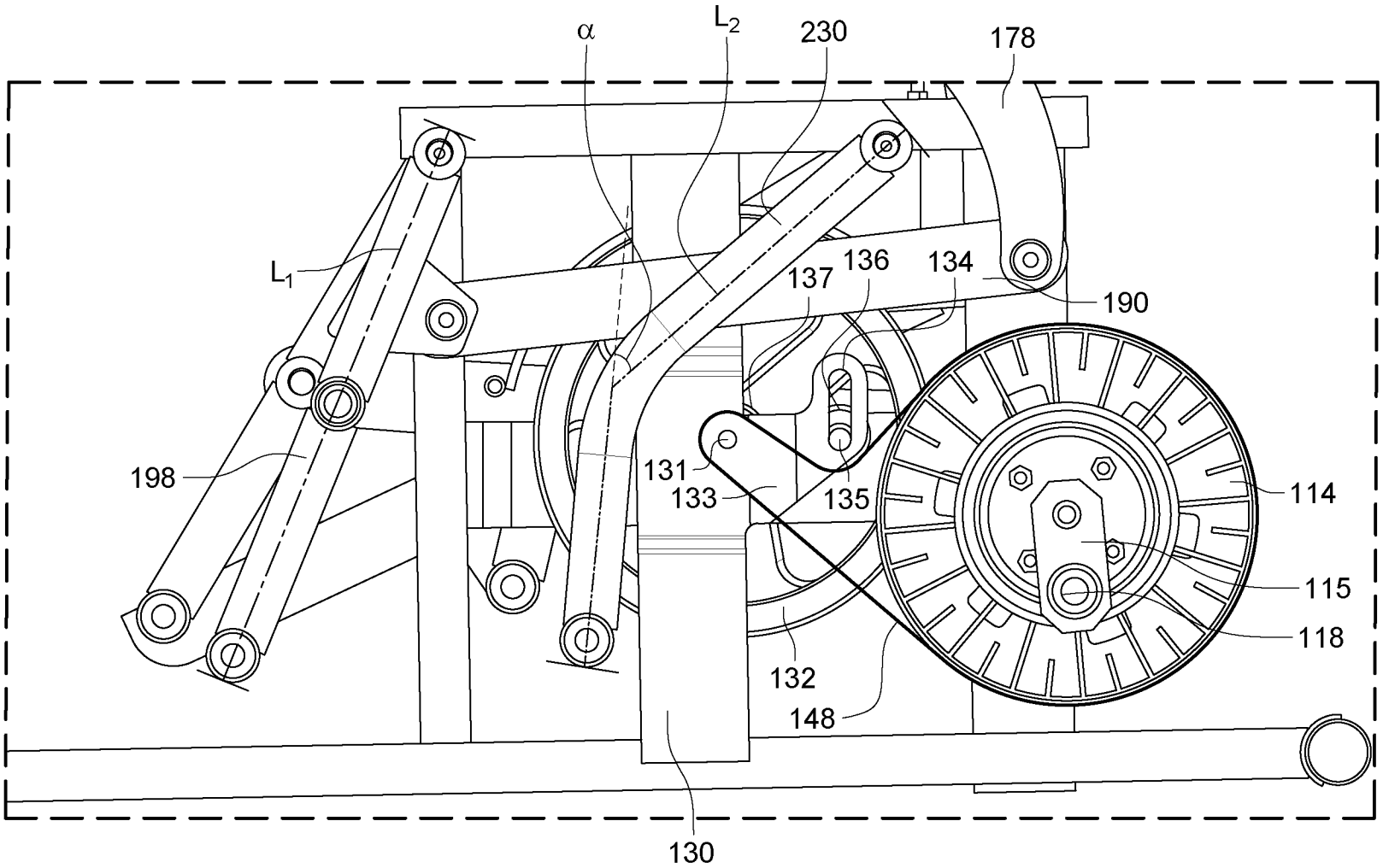
FIG. 6 is a side view of a resistance assembly of the exercise apparatus shown in FIG. 1.

The front support frame 112 includes a crank axle mount 113 through which a crank axle 113*a* extends coaxially, as shown in FIG. 4, forming a first axis, and the crank axle 113*a* is rotatable relative to the crank axle mount 113. A crank wheel 114 (with an outer surface forming a crank pulley (second pulley)) is operatively connected to the crank axle 113*a*. A belt 148 is routed partially about the crank wheel 114 (crank pulley) and the resistance pulley 137, as shown in FIG. 6, and the idler pulley 136 contacts the belt 148 therebetween to selectively exert force on the belt 148, to selectively tension the belt 148, thereby providing a resistance device to selectively provide a desired resistance on the crank wheel 114. A connector or crank arm 115 is rotatably connected to each distal end of the crank axle 113. The crank arm 115 has a first end 116 operatively connected to the distal end of the crank axle 113 with a fastener so that the crank arm 115 can pivot about the fastener. A second end 117 of the crank arm 115 extends outward from the crank axle 113 and includes an aperture 118 configured and arranged to receive an axle 214 extending outward from a second end 213 of a crank link 210.

A frame extension 150 extends upward from the top support frame 140 and includes an axle 151 (forming a fourth axis) extending outward from each side. A stop 152 extends upward from a distal end of the frame extension 150, and a bracket 153 pivotally interconnects the frame extension 150 and a proximal end 159 of a mast 158 with a pin 154. A display screen 162 is operatively connected to a distal end 161 of the mast 158. At least one fastener 163 extends through aligned apertures in the stop 152 and the mast 158 to secure the mast 158 in an upright, use position 250 relative to the stop 152. The at least one fastener 163 is removed to pivot the mast 158 downward about the pin 154 into a storage position 251.

In an example, the first axis extends through and outward from opposing sides of the support frame substantially perpendicular to the sagittal plane. The second axis extends through and outward from opposing sides of the support frame substantially perpendicular to the sagittal plane, superior and rearward of a first axis. The third axis extends through and outward from opposing sides of the support frame substantially perpendicular to the sagittal plane superior of the first axis, substantially horizontal and forward of the second axis, disposed medially to the first axis and the second axis. The optional fourth axis extends substantially perpendicular to the sagittal plane, disposed proximal to the support frame and superior to the first axis. The optional fifth axis extends substantially perpendicular to the sagittal plane, disposed superior to the first axis, substantially horizontal and forward of the second axis.

A linkage assembly is operatively connected to each side of the support frame 130, a left linkage assembly 165*a* and a right linkage assembly 165*b*. Preferably, each linkage assembly includes substantially similar or mirror image components, which are referred to using corresponding reference numerals.

An arm or handle 166 is preferably tubular, forming a bore 168 extending therethrough, with a proximal or first end 167 including at least one aperture 169 and a distal or second end 170 to which a handle 172 is operatively connected. Optionally, as shown in this example, the handle 172 fits within the bore 168 and includes apertures 173 configured and arranged to selectively align with an adjustment mechanism 174 operatively connected to the distal end 170 to adjust the length of the handle 172 extending from the arm or handle 166. The proximal end 167 is operatively connected to an arm support 178, which is pivotally coupled to the axle 151 about the fourth axis. A connector 180, which is preferably cylindrical, extends outward from a first end 179 of the arm support 178, and an extension 182 including at least one ball plunger 183, extends outward from the connector 180. The extension 182 is configured and arranged to fit within the bore 168 and the at least one ball plunger 183 engages the first end 167 by partially extending through the at least one aperture 169. A second end 184 of the arm support 178 includes an aperture 185.

An arm link 190 includes a first end 191 with an aperture 192 and a second end 193 with an aperture 194. A fastener extends through the aperture 194 and the aperture 185 to pivotally interconnect the arm link 190 and the arm support 178. A first elongate member 198 includes a first end 199 with a bore 200, an intermediate portion 203 with a bore 204, and a second end 205 with a bore 206. Between the bores 200 and 204, an extension 201 extends forward from the first elongate member 198 and includes an aperture 202. Preferably, the extension 201 is fixedly connected to the first elongate member 198. A fastener extends through the aperture 192 and the aperture 202 to pivotally interconnect the arm link 190 to the first elongate member 198. A crank link 210 includes a first end 211 from which an axle 212 extends and a second end 213 from which an axle 214 extends. The axle 212 fits in the bore 204 and the axle 214 fits in the aperture 118 to pivotally interconnect the crank link 210 to the first elongate member 198 and to the connector 115.

Figure 7:
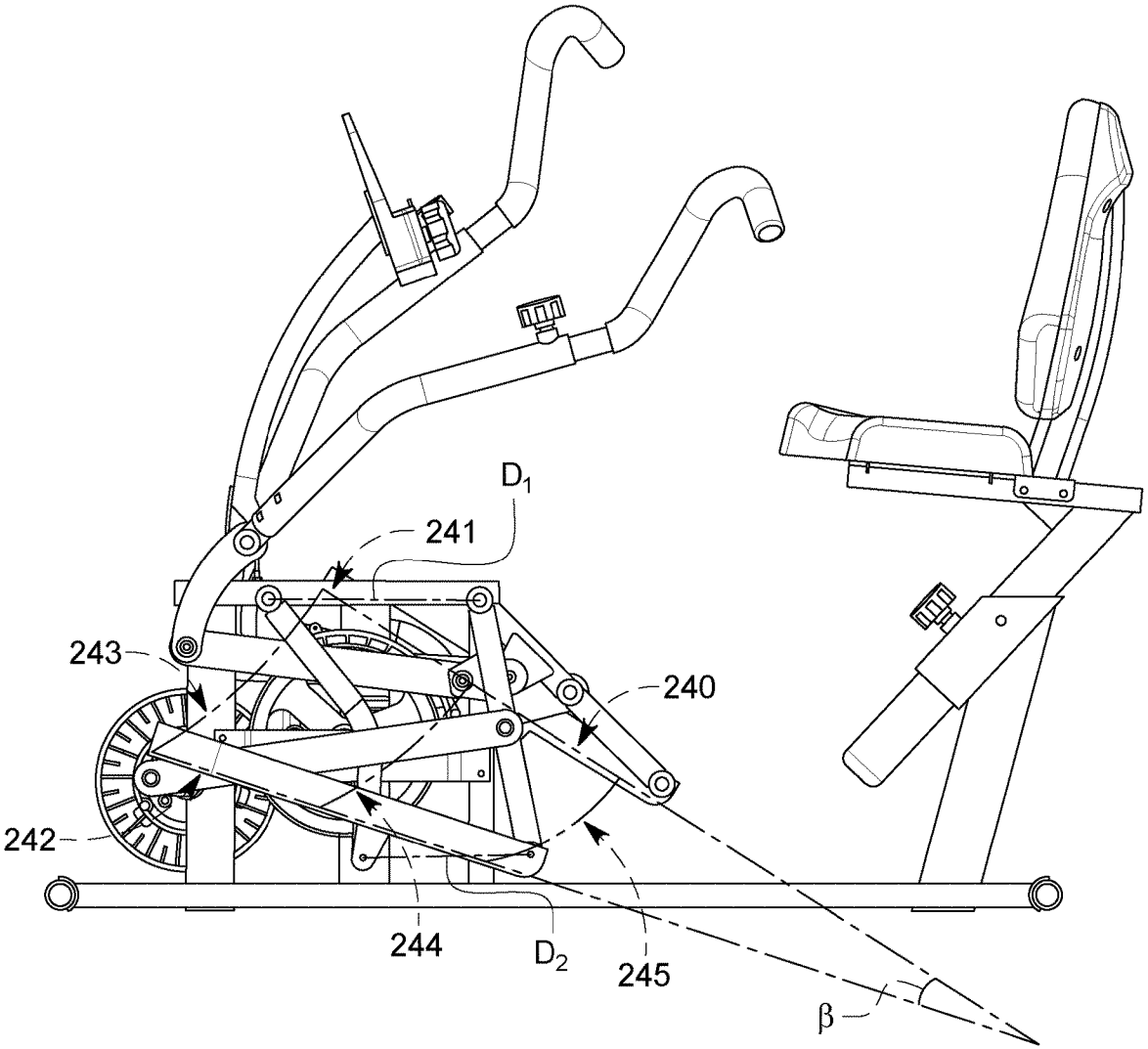
FIG. 7 is a side view of the exercise apparatus shown in FIG. 1 illustrating a pedal path in phantom lines.

A second elongate member 230 (pedal link) includes a first end 231 with a bore 232, an intermediate portion 233, and a second end 234 with a bore 235. Preferably, the intermediate portion 233 is bent, or nonlinear. In an example, the intermediate portion 233 is bent approximately 35 to 45 degrees toward the front support frame portion, angle $\alpha$ as illustrated in FIG. 6. The first axle 142 extends through the bore 232 to pivotally interconnect the second elongate member 230 and the top support frame 140. In an example, the first elongate member 198 has a length $L_1$ from end to end and the second elongate member 230 has a length $L_2$ from end to end and $L_1$ is shorter in length than $L_2$, as illustrated in FIG. 6, and a distance $D_1$ from the second axis to the third axis is larger than a distance $D_2$ from the first pedal ends to respective pedal intermediate portions of the right and left pedals creating generally linear pedal paths while forming angle $\beta$, as shown in FIG. 7, between top and bottom strokes of the pedals thereby simulating a user's natural foot movement during use.

A pedal 218 includes a toe portion 219 and a heel portion 220 with an extension 222 extending downward therebetween. The heel portion 220 includes a bore 221 and the extension 222 includes a bore 223. A connector rod 226 extends through the bore 221 and the bore 206 to pivotally interconnect the heel portion 220 and the first elongate member 198. A connector rod 227 extends through the bore 223 and the bore 235 to pivotally interconnect the extension 222 and the second elongate member 230 (pedal link). In an example, the first linkage assembly 165*a* and the second linkage assembly 165*b* are disposed within a transverse projection of a first pedal path 240 of the first pedal 218 to a second pedal path 240 of the second pedal 218.

In use, a user sits on the seat 110 and positions their feet on the pedals 218. When a user is seated on the seat 110 of the seat assembly 109 proximate the rear of the exercise apparatus, facing the display screen 162 proximate the front of the exercise apparatus, the user's sagittal plane assists in defining a right side and a left side of the exercise apparatus relative to the user's perspective. Optionally, because the exercise apparatus 100 can be used with or without arms or handles, the user places their hands on the handles 172, if used. To move the pedals 218, the user alternates stepping on the pedals 218, similar to walking or running, and the pedals move the linkage assemblies, which move the optional handles 172, if used. The arms 166 and handles 172 are optional and, therefore, the arm supports 178 and arm links 190 are optional. If the handles 172 are used, they pivot forward and backward, which can assist in moving the linkage assemblies along with the pedals 218. The crank arms 115 are substantially out of phase from one another during use thereby creating a synchronous stepping motion with the pedals. The linkage assemblies pivotally move to move the pedals in pedal paths. An example pedal path 240 is illustrated in FIG. 7. The pedal path 240 includes a top stroke 241, a bottom stroke 242, a front 243, a center 244, and a rear 245.

This type of connection for the handle support members is beneficial because having the connection points for first link and the second link medial and integrated into the first member creates a strong connection point with less stress on components. This configuration also allows the handle support members to operate in an opposing and synchronous movement with the first pedal member and the second pedal member.

Resistance is selectively placed on the linkage assemblies by the crank wheel 114 connected to the crank link 210 via the connector 115. The idler pulley 136 moves within the slot 134 to decrease or increase tension on the belt 148, as shown in FIG. 6. If the idler pulley 136 is positioned toward the top of the slot 134, there is less tension/resistance. If the idler pulley 136 is positioned toward the bottom of the slot 134, there is more tension/resistance. The idler pulley 136 is selectively positioned by suitable means known in the art. For example, the idler pulley 136 can be selectively positioned by a movable and fixable axis on the support frame 130 to remove slack in the drive system power transmission components.

Figure 8:
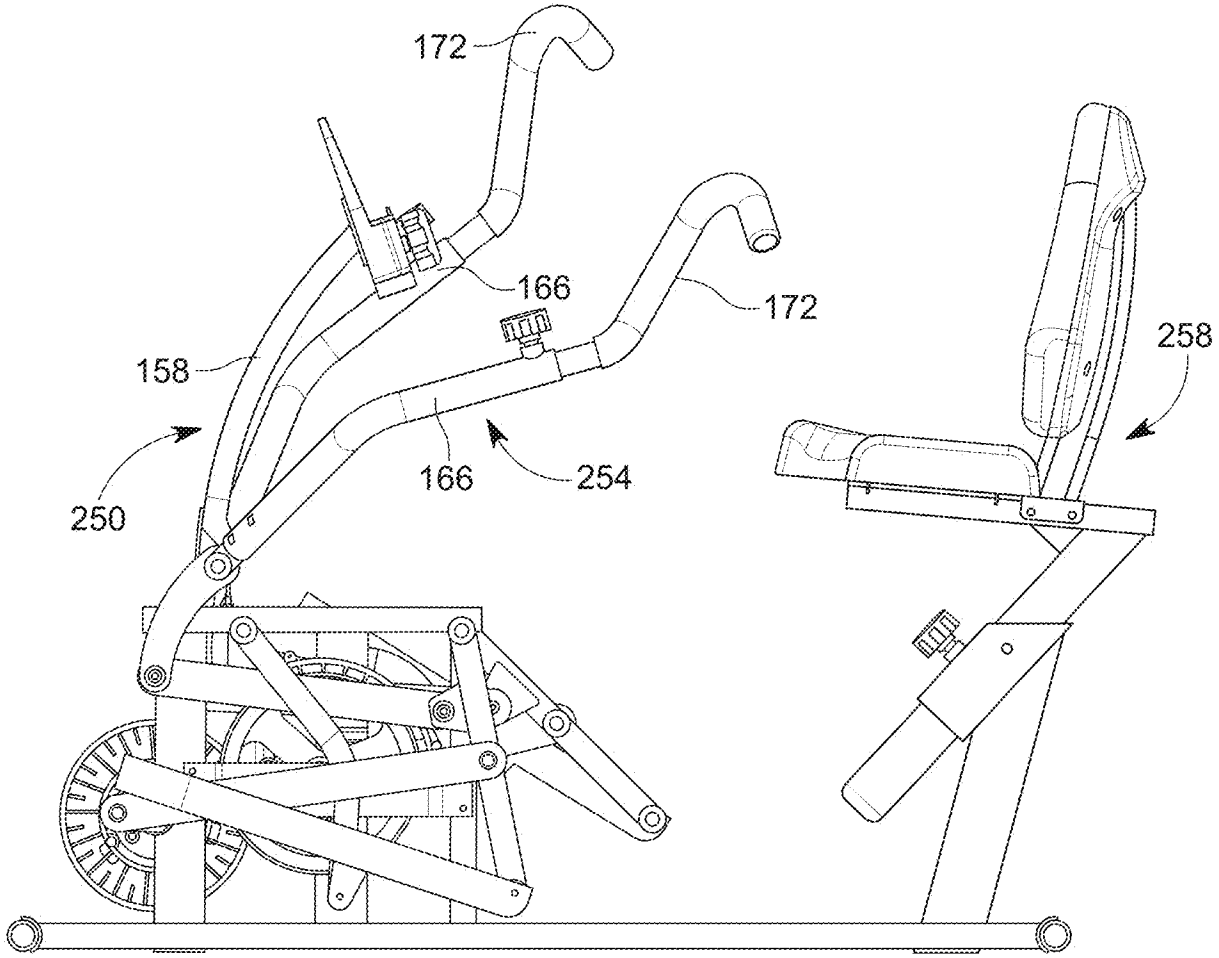
FIG. 8 is a side view of the exercise apparatus shown in FIG. 1 in a mast upright position, connected handle position, and connected seat position.
Figure 9:
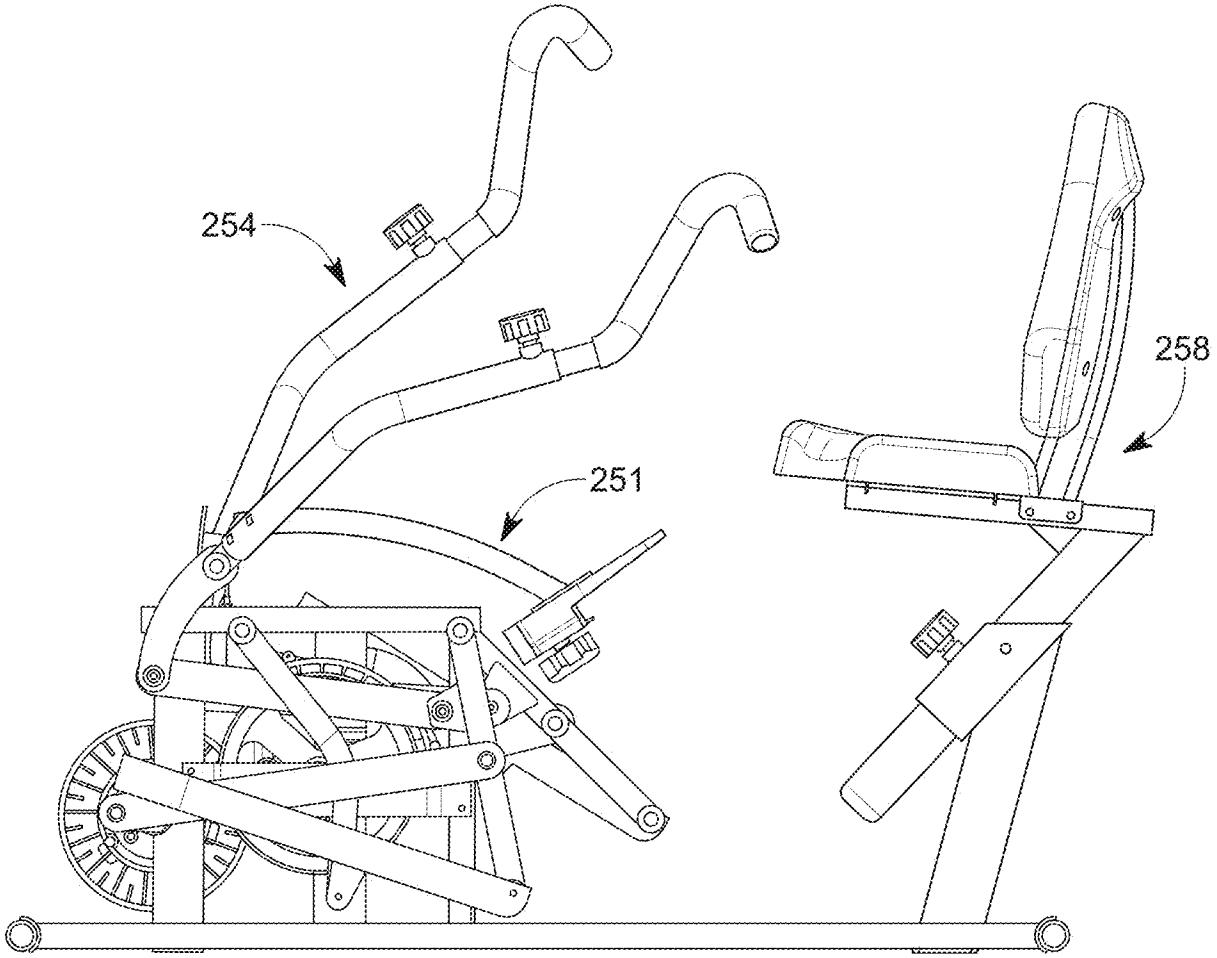
FIG. 9 is a side view of the exercise apparatus shown in FIG. 1 in a mast storage position, connected handle position, and connected seat position.
Figure 10:
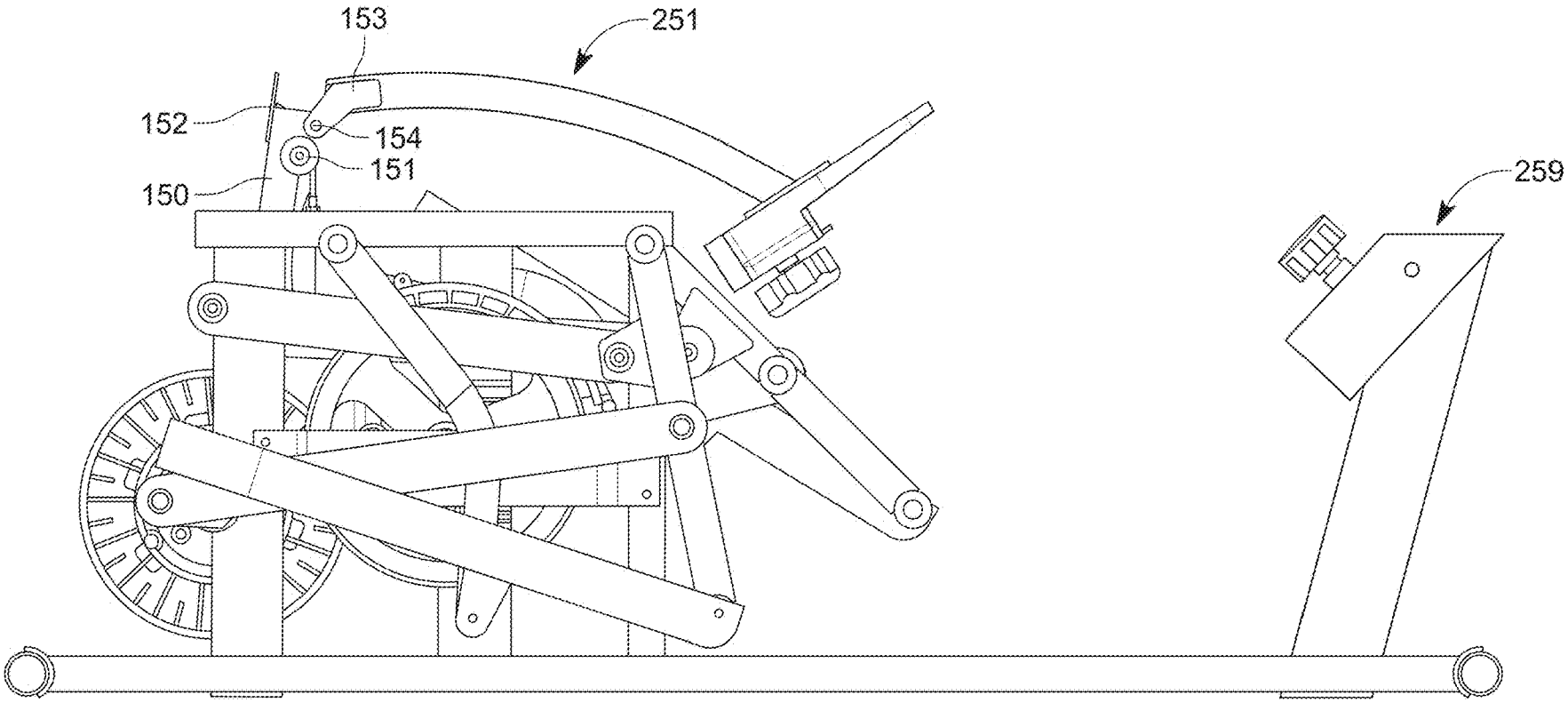
FIG. 10 is a side view of the exercise apparatus shown in FIG. 1 in a mast storage position, disconnected handle position, and disconnected seat position with an arm support removed.
Figure 11:
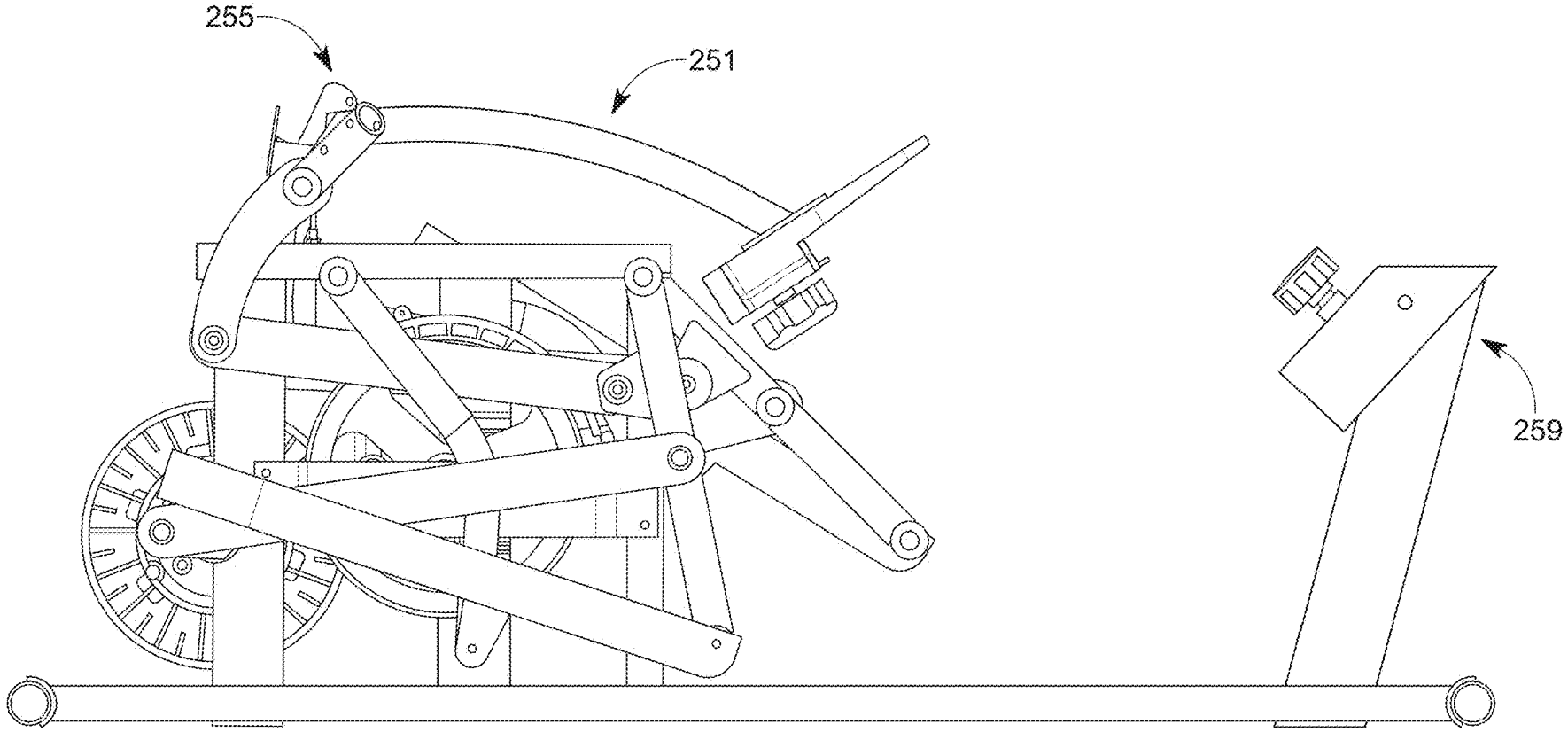
FIG. 11 is a side view of the exercise apparatus shown in FIG. 1 in a mast storage position, disconnected handle position, and disconnected seat position.

To move the exercise apparatus 100 from a use position to a storage position, or vice versa, fasteners interconnecting the stop 152 and the mast 158 are removed, allowing the mast 158 to pivot from a mast upright position 250 shown in FIG. 8 to a mast storage position 251 shown in FIGS. 9-11. The arms 166 and associated handles 172 are removed by compressing the ball plungers 183, so that they do not extend through the apertures 169, and sliding the arms 166 off the arm support extensions 182. An arm connected position 254 is shown in FIGS. 8 and 9, and an arm storage position 255 is shown in FIG. 11. The seat is removed by removing the fastener from an aperture in a seat post and sliding the seat post out of the seat frame sleeve. A seat connected position 258 is shown in FIGS. 8 and 9, and a seat storage position 259 shown in FIGS. 10 and 11. The components can be positioned in use or storage positions in any desired order. The storage position is also useful for shipping or transporting the exercise apparatus.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. A front crank assembly for use with an exercise apparatus having a support frame including a top support frame portion, a bottom support frame portion, a front support frame portion, and a rear support frame portion, the support frame being positioned proximate a front of the exercise apparatus, comprising:

a crank wheel configured and arranged to be rotatably connected to the front support frame portion of the support frame;

a crank link having a first crank link end and a second crank link end, the first crank link end being pivotally connected to the crank wheel;

an elongate member having a first elongate member end, an elongate member intermediate portion, and a second elongate member end, the first elongate member end configured and arranged to be pivotally connected to the top support frame portion proximate the rear support frame portion, the second crank link end being pivotally connected to the elongate member intermediate portion;

a pedal link having a first pedal link end, a pedal link intermediate portion, and a second pedal link end, the first pedal link end configured and arranged to be pivotally connected to the top support frame portion proximate the front, the first pedal link being positioned between the crank wheel and the elongate member; and a pedal having a first pedal end, a pedal intermediate portion, and a second pedal end, the second elongate member end being pivotally connected to the second pedal end, and the second pedal link end being pivotally connected to the pedal intermediate portion.

2. The front crank assembly of claim 1, wherein the pedal link intermediate portion is bent.

3. The front crank assembly of claim 2, wherein the pedal link intermediate portion is bent approximately 35 to 45 degrees toward the front support frame portion.

4. The front crank assembly of claim 1, further comprising an extension portion extending outward from the elongate member between the first elongate member end and the elongate member intermediate portion;

an arm link having a first arm link end and a second arm link end, the second arm link end being pivotally connected to the extension portion;

an arm support having a first arm support end and a second arm support end, the first arm support end configured and arranged to be pivotally connected to the top support frame portion, the second arm support end being pivotally connected to the first arm link end; and an arm operatively connected to the first arm support end.

5. The front crank assembly of claim 4, wherein the extension portion is fixedly connected to the elongate member.

6. A front crank assembly for use with an exercise apparatus, comprising:

a support frame including a top support frame portion, a bottom support frame portion, a front support frame portion, and a rear support frame portion, the support frame being positioned proximate a front of the exercise apparatus;

a crank wheel rotatably connected to the front support frame portion of the support frame;

a crank link having a first crank link end and a second crank link end, the first crank link end being pivotally connected to the crank wheel;

an elongate member having a first elongate member end, an elongate member intermediate portion, and a second elongate member end, the first elongate member end being pivotally connected to the top support frame portion proximate the rear support frame portion, the second crank link end being pivotally connected to the elongate member intermediate portion;

a pedal link having a first pedal link end, a pedal link intermediate portion, and a second pedal link end, the first pedal link end being pivotally connected to the top support frame portion proximate the front, the pedal link intermediate portion being bent; and a pedal having a first pedal end, a pedal intermediate portion, and a second pedal end, the second elongate member end being pivotally connected to the second pedal end, and the second pedal link end being pivotally connected to the pedal intermediate portion.

7. The front crank assembly of claim 6, further comprising an extension portion extending outward from the elongate member between the first elongate member end and the elongate member intermediate portion;

an arm link having a first arm link end and a second arm link end, the second arm link end being pivotally connected to the extension portion;

an arm support having a first arm support end and a second arm support end, the first arm support end being pivotally connected to the top support frame portion, the second arm support end being pivotally connected to the first arm link end; and an arm operatively connected to the first arm support end.

8. The front crank assembly of claim 7, wherein the extension portion is fixedly connected to the elongate member.

9. The front crank assembly of claim 6, wherein the pedal link intermediate portion is bent approximately 35 to 45 degrees toward the front support frame portion.

10. An exercise apparatus, comprising:

a base frame configured and arranged to occupy a stable operating position on an underlying horizontal support surface, wherein the base frame defines a front end and a rear end;

a seat assembly selectively coupled to the rear end of the base frame and including a seat facing the front end of the base frame, the seat assembly relative to the base frame configured and arranged to define a right side and a left side;

a support frame extending upward from the base frame proximate the front end of the base frame;

a first axis extending through and outward from opposing sides of the support frame;

a second axis extending through and outward from opposing sides of the support frame, superior and rearward of the first axis;

a third axis extending through and outward from opposing sides of the support frame, superior of the first axis, substantially horizontal and forward of the second axis, disposed medially to the first axis and the second axis;

a crank axle rotatably mounted to the support frame and coaxial with the first axis;

a crank wheel operatively connected to the crank axle;

a first linkage assembly disposed to the right side of the base frame comprising:

a right crank link having a first right crank link end and a second right crank link end, the first right crank link end being pivotally connected to the crank wheel;

a right elongate member having a first right elongate member end, a right elongate member intermediate portion, and a second right elongate member end, the first right elongate member end being pivotally connected to a top support frame portion proximate a rear support frame portion of the support frame, the second right crank link end being pivotally connected to the right elongate member intermediate portion;

a right pedal link having a first right pedal link end, a right pedal link intermediate portion, and a second right pedal link end, the first right pedal link end being pivotally connected to the top support frame portion proximate a front support frame portion of the support frame; and a right pedal having a first right pedal end, a right pedal intermediate portion, and a second right pedal end, the second right elongate member end being pivotally connected to the second right pedal end, and the second right pedal link end being pivotally connected to the right pedal intermediate portion;

a second linkage assembly disposed to the left side of the base frame comprising:

a left crank link having a first left crank link end and a second left crank link end, the first left crank link end being pivotally connected to the crank wheel;

a left elongate member having a first left elongate member end, a left elongate member intermediate portion, and a second left elongate member end, the first left elongate member end being pivotally connected to the top support frame portion proximate the rear support frame portion, the second left crank link end being pivotally connected to the left elongate member intermediate portion;

a left pedal link having a first left pedal link end, a left pedal link intermediate portion, and a second left pedal link end, the first left pedal link end being pivotally connected to the top support frame portion proximate the front support frame portion; and a left pedal having a first left pedal end, a left pedal intermediate portion, and a second left pedal end, the second left elongate member end being pivotally connected to the second left pedal end, and the second left pedal link end being pivotally connected to the left pedal intermediate portion;

wherein the first linkage assembly and the second linkage assembly are disposed within a transverse projection of a first pedal path of the first pedal to a second pedal path of the second pedal.

11. The exercise apparatus of claim 10, further comprising:

a fifth axis disposed superior to the first axis, forward of the second axis;

a resistance device rotatably mounted on the support frame about the fifth axis and operatively connected to the crank wheel to provide selected resistance on the crank wheel.

12. The exercise apparatus of claim 11, further comprising:

a first pulley operatively connected to the resistance device;

a second pulley disposed on the first axis, wherein an outer surface of the crank wheel forms the second pulley;

a belt routed about the first pulley and the second pulley and configured and arranged to provide the selected resistance on the crank wheel.

13. The exercise apparatus of claim 11, further comprising:

a third pulley operatively connected to the support frame between the first pulley and the second pulley, the third pulley being moveable to place a desired amount of pressure on the belt thereby resulting in the selected resistance.

14. The exercise apparatus of claim 10, wherein the right elongate member and the left elongate member are shorter in length from end to end than the right pedal link and the left pedal link, respectively, wherein a distance from the second axis to the third axis is larger than a distance from the first right pedal end and the left pedal end to the right pedal intermediate portion and the left pedal intermediate portion, respectively, creating linear paths of the first pedal path and the second pedal path while forming angle β between top and bottom strokes of the right pedal and the left pedal thereby simulating a user's natural foot movement during use.

15. The exercise apparatus of claim 10, further comprising a right crank arm and a left crank arm, the right crank arm being disposed to the right side of the base frame and the left crank arm being disposed to the left side of the base frame, each of the right crank arm and the left crank arm having a first crank arm end and a second crank arm end, the first crank arm end operatively connected to a distal end of the crank axle, the right crank arm and the left crank arm being out of phase from one another during use thereby creating a synchronous stepping motion with the right pedal and the left pedal.

16. The exercise apparatus of claim 10, wherein a space between the support frame and the seat assembly is configured and arranged to allow the user to step through the space for positioning on and off the exercise apparatus.

17. The exercise apparatus of claim 10, further comprising:

a fourth axis disposed proximal to the support frame and superior to the first axis;

a right arm support disposed on the right side having a first right arm support end, a second right arm support end, and a right arm support connector operatively connected to the first right arm support end, the right arm support connector being pivotally coupled about the fourth axis, the first right arm support end being operatively connected to a right handle;

a right arm link having a first right arm link end and a second right arm link end, the first right arm link end being pivotally coupled to the right elongate member intermediate portion, the second right arm link end being pivotally coupled to the second right arm support end;

a left arm support disposed on the left side having a first left arm support end, a second left arm support end, and a left arm support connector operatively connected to the first left arm support end, the left arm support connector being pivotally coupled about the fourth axis, the first left arm support end being operatively connected to a left handle; and a left arm link having a first left arm link end and a second left arm link end, the first left arm link end being pivotally coupled to the left elongate member intermediate portion, the second left arm link end being pivotally coupled to the second left arm support end.

18. The exercise apparatus of claim 10, further comprising a mast extending upward from the support frame, the mast having an upright position and a storage position.

19. The exercise apparatus of claim 10, further comprising a wheel operatively connected to at least the front end of the base frame.

* * * * *